US010995563B2

(12) United States Patent
Søe et al.

(10) Patent No.: US 10,995,563 B2
(45) Date of Patent: May 4, 2021

(54) ROTARY DRILL HEAD FOR COILED TUBING DRILLING APPARATUS

(71) Applicant: MINEX CRC LTD, Kensington (AU)

(72) Inventors: Søren Pham Søe, South Australia (AU); Shane Lee Fox, South Australia (AU)

(73) Assignee: MINEX CRC LTD, Kensington (AU)

( * ) Notice: Subject to any disclaimer, the term of this patent is extended or adjusted under 35 U.S.C. 154(b) by 0 days.

(21) Appl. No.: 16/476,786

(22) PCT Filed: Oct. 11, 2017

(86) PCT No.: PCT/AU2017/051098
§ 371 (c)(1),
(2) Date: Jul. 9, 2019

(87) PCT Pub. No.: WO2018/132862
PCT Pub. Date: Jul. 26, 2018

(65) Prior Publication Data

US 2019/0360283 A1 Nov. 28, 2019

(30) Foreign Application Priority Data

Jan. 18, 2017 (AU) ..... 2017900143
May 30, 2017 (WO) ..... PCT/AU2017/050508

(51) Int. Cl.
*E21B 19/08* (2006.01)
*E21B 3/04* (2006.01)
(Continued)

(52) U.S. Cl.
CPC ..... *E21B 19/08* (2013.01); *B65H 75/425* (2013.01); *B65H 75/4405* (2013.01); *E21B 3/02* (2013.01);
(Continued)

(58) Field of Classification Search
CPC . E21B 7/02; E21B 7/023; E21B 17/02; E21B 17/041; E21B 19/08; E21B 19/22; E21B 3/045
See application file for complete search history.

(56) References Cited

U.S. PATENT DOCUMENTS 2,848,196 A 8/1958 Simmonds
3,517,760 A 6/1970 Kehrberger
(Continued)

FOREIGN PATENT DOCUMENTS

AU 2010100358 A4 5/2010
AU 2011101137 A4 10/2011
(Continued)

OTHER PUBLICATIONS

International Search Report for PCT/AU2017/051098, dated Dec. 6, 2017.
(Continued)

*Primary Examiner* — Robert E Fuller
*Assistant Examiner* — Lamia Quaim
(74) *Attorney, Agent, or Firm* — Marshall, Gerstein & Borun LLP

(57) ABSTRACT

A mobile, coiled tubing drilling apparatus with a rotary drill head, includes a non-rotating mast on a mobile platform. The mast has mounted thereon an injector below a coiled tubing reel. The injector defines an operational axis for the coiled tubing. The rotary drill head is pivotally mounted on the injector so as to be movable between a retracted position away from the operational axis and an operating position in line with the operational axis. The rotary drill head includes a top swivel for non-rotating connection to the coiled tubing and a bottom spindle for rotating connection to a pipe section. The top swivel and the bottom spindle provide fluid
(Continued)

communication between connected coiled tubing and connected pipe section during operation.

9 Claims, 8 Drawing Sheets

(51) Int. Cl.

| | |
|---|---|
| ***B65H 75/42*** | (2006.01) |
| ***B65H 75/44*** | (2006.01) |
| ***E21B 7/02*** | (2006.01) |
| ***E21B 19/24*** | (2006.01) |
| ***E21B 19/22*** | (2006.01) |
| ***E21B 3/02*** | (2006.01) |
| ***E21B 15/00*** | (2006.01) |

(52) U.S. Cl.
CPC ..... *E21B 3/045* (2013.01); *E21B 7/02* (2013.01); *E21B 7/021* (2013.01); *E21B 7/023* (2013.01); *E21B 15/00* (2013.01); *E21B 19/22* (2013.01); *E21B 19/24* (2013.01); *B65H 2701/33* (2013.01)

(56) References Cited

U.S. PATENT DOCUMENTS 3,557,885 A 1/1971 Cales
3,631,933 A 1/1972 Bryant
3,658,270 A 4/1972 Slator et al.
3,690,136 A 9/1972 Slator et al.
3,765,486 A 10/1973 Dittmer et al.
3,817,466 A 6/1974 Reynard et al.
3,936,733 A 2/1976 Clary
3,965,685 A 6/1976 D'Amiano
3,980,144 A 9/1976 Roos et al.
3,991,837 A 11/1976 Crickmer
3,995,701 A 12/1976 Kelly, Jr.
3,995,829 A 12/1976 Foik
4,015,672 A 4/1977 Kinnison
4,102,411 A 7/1978 Webb et al.
4,145,014 A 3/1979 Chatard et al.
4,173,130 A 11/1979 Downen et al.
4,248,312 A 2/1981 Jinno et al.
4,249,600 A 2/1981 Bailey
4,265,304 A 5/1981 Baugh
4,279,314 A 7/1981 Taub
4,304,310 A 12/1981 Garrett
4,336,840 A 6/1982 Bailey
4,341,270 A 7/1982 Ferguson
4,476,945 A 10/1984 Hearn
4,515,211 A 5/1985 Reed et al.
4,515,220 A 5/1985 Sizer et al.
4,553,612 A 11/1985 Durham
4,585,061 A 4/1986 Lyons et al.
4,591,131 A 5/1986 Rhoads
4,667,750 A 5/1987 Wise et al.
4,697,648 A 10/1987 Brandt
4,756,366 A 7/1988 Maroney et al.
4,878,546 A 11/1989 Shaw et al.
4,889,193 A 12/1989 Shy
4,923,005 A 5/1990 Laky et al.
4,949,791 A 8/1990 Hopmann et al.
5,027,903 A 7/1991 Gipson
5,090,039 A 2/1992 Gard et al.
5,094,302 A 3/1992 Back
5,115,861 A 5/1992 Laky
5,133,405 A 7/1992 Elliston
H001116 H 12/1992 Love, Jr.
5,186,253 A 2/1993 Gustafson et al.
5,211,203 A 5/1993 Vollweiler et al.
5,211,248 A 5/1993 Nosewicz et al.
5,303,783 A 4/1994 Begnaud et al.
5,360,075 A 11/1994 Gray
5,435,385 A 7/1995 Wilson
5,439,066 A 8/1995 Gipson
5,515,925 A 5/1996 Boychuk
5,515,926 A 5/1996 Boychuk
5,524,708 A 6/1996 Isaacs
5,524,716 A 6/1996 Wachholz
5,547,314 A 8/1996 Ames
5,553,668 A 9/1996 Council et al.
5,566,764 A 10/1996 Elliston
5,566,769 A 10/1996 Stuart
5,575,332 A 11/1996 Wasterval, Jr.
5,727,631 A 3/1998 Baker et al.
5,738,173 A 4/1998 Burge et al.
5,775,417 A 7/1998 Council
5,839,514 A 11/1998 Gipson
5,865,392 A 2/1999 Blount et al.
5,875,850 A 3/1999 Burge et al.
5,918,671 A 7/1999 Bridges et al.
5,931,229 A 8/1999 Lehr et al.
5,937,943 A 8/1999 Butler
5,988,274 A 11/1999 Funk
6,000,480 A 12/1999 Eik
6,003,598 A 12/1999 Andreychuk
6,009,941 A 1/2000 Haynes
6,142,406 A 11/2000 Newman
6,158,516 A 12/2000 Smith et al.
6,209,633 B1 4/2001 Haynes
6,209,634 B1 4/2001 Avakov et al.
6,230,805 B1 5/2001 Vercaemer et al.
6,431,286 B1 8/2002 Andreychuk
6,481,507 B1 11/2002 Kromray, Jr.
6,527,055 B1 3/2003 Gipson
6,868,902 B1 3/2005 Roodenburg et al.
6,932,553 B1 8/2005 Roodenburg et al.
6,951,256 B1 10/2005 Xiao
7,152,672 B1 12/2006 Gipson
7,284,618 B2 10/2007 Geddes et al.
7,341,101 B1 3/2008 Moretz
7,681,632 B2 3/2010 Wood
7,753,344 B1 7/2010 Moretz et al.
7,810,556 B2 10/2010 Havinga
8,544,537 B1 10/2013 Keast
9,074,432 B1 7/2015 Crosby et al.
9,151,116 B1 10/2015 Galvez
9,309,730 B2 4/2016 Korach et al.
9,316,067 B1 4/2016 Lu et al.
2002/0000332 A1 1/2002 Merecka et al.
2002/0074125 A1 6/2002 Fikes et al.
2002/0117308 A1 8/2002 Dallas
2003/0006034 A1 1/2003 Neal
2003/0010505 A1 1/2003 Gipson
2003/0070841 A1 4/2003 Merecka et al.
2003/0079883 A1 5/2003 McCulloch et al.
2003/0106695 A1 6/2003 Fikes et al.
2003/0121682 A1 7/2003 Carrancho
2003/0159821 A1 8/2003 Andersen et al.
2003/0168218 A1 9/2003 Head
2003/0221822 A1 12/2003 Polsky et al.
2003/0226667 A1 12/2003 Hill
2004/0159443 A1 8/2004 Austbo et al.
2004/0163805 A1 8/2004 Smith et al.
2004/0173347 A1 9/2004 Dallas
2004/0182574 A1 9/2004 Adnan et al.
2004/0195007 A1 10/2004 Eppink
2004/0206551 A1 10/2004 Carriere et al.
2004/0211555 A1 10/2004 Austbo et al.
2004/0211598 A1 10/2004 Palidis
2004/0221994 A1 11/2004 Kauffman et al.
2004/0244993 A1 12/2004 Crawford et al.
2004/0262015 A1 12/2004 Mazzella et al.
2005/0000693 A1 1/2005 Ravensbergen et al.
2005/0051344 A1 3/2005 Goss
2005/0072587 A1 4/2005 Clelland
2005/0077039 A1 4/2005 Shahin et al.
2005/0103529 A1 5/2005 Rossi
2005/0126821 A1 6/2005 Davies
2005/0161225 A1 7/2005 Cole et al.
2005/0161230 A1 7/2005 Webre et al.
2005/0205267 A1 9/2005 Dallas
2005/0211430 A1 9/2005 Patton et al.

(56) References Cited

U.S. PATENT DOCUMENTS

2005/0247455 A1 11/2005 Domann
2005/0247456 A1 11/2005 Wise et al.
2005/0252654 A1 11/2005 Watson
2005/0263281 A1 12/2005 Lovell et al.
2005/0269072 A1 12/2005 Folk et al.
2005/0279507 A1 12/2005 Folk et al.
2006/0000619 A1 1/2006 Borst et al.
2006/0011350 A1 1/2006 Wiggins et al.
2006/0048933 A1 3/2006 Van Way
2006/0054315 A1 3/2006 Newman
2006/0065407 A1 3/2006 Rufey
2006/0081368 A1 4/2006 Rosine et al.
2006/0207767 A1 9/2006 Andreychuk
2006/0231267 A1 10/2006 Wood
2006/0231268 A1* 10/2006 Wood ..... E21B 7/02 166/379
2006/0231269 A1 10/2006 Wood
2006/0243490 A1 11/2006 Riel
2006/0249292 A1 11/2006 Guidry
2006/0254780 A1 11/2006 McWhorter et al.
2006/0260844 A1 11/2006 Patton et al.
2006/0273213 A1 12/2006 Turk et al.
2006/0278387 A1 12/2006 Parker
2006/0283587 A1 12/2006 Wood et al.
2006/0283588 A1 12/2006 Wood et al.
2006/0283605 A1 12/2006 Wood et al.
2006/0289170 A1 12/2006 Wood
2006/0289171 A1 12/2006 Wood et al.
2007/0095525 A1 5/2007 Austbo et al.
2007/0113640 A1 5/2007 De et al.
2007/0114041 A1 5/2007 Wood et al.
2007/0125549 A1 6/2007 Wood
2007/0125551 A1 6/2007 Havinga
2007/0125552 A1 6/2007 Wood et al.
2007/0131432 A1 6/2007 Pleskie
2007/0137855 A1 6/2007 Nielsen et al.
2007/0187108 A1 8/2007 Zheng
2007/0193734 A1 8/2007 Dallas
2007/0193749 A1 8/2007 Folk
2007/0209791 A1 9/2007 Havinga
2007/0209840 A1 9/2007 Boys
2007/0215359 A1 9/2007 Wood et al.
2007/0221386 A1 9/2007 Rock et al.
2007/0251700 A1 11/2007 Mason et al.
2007/0295497 A1 12/2007 Pleskie et al.
2008/0006400 A1 1/2008 Coyle, Jr.
2008/0023227 A1 1/2008 Patton
2008/0135228 A1 6/2008 Wells et al.
2008/0185184 A1 8/2008 Maguire
2008/0202812 A1 8/2008 Childers et al.
2008/0217061 A1 9/2008 Barbera
2008/0245575 A1 10/2008 Guidry
2008/0264626 A1 10/2008 Patton
2008/0296013 A1 12/2008 Pleskie
2008/0302530 A1 12/2008 Shampine et al.
2008/0308281 A1 12/2008 Boutwell et al.
2009/0025980 A1 1/2009 Callander et al.
2009/0095491 A1 4/2009 Wood et al.
2009/0101361 A1 4/2009 Mason et al.
2009/0114403 A1 5/2009 Borst et al.
2009/0126946 A1 5/2009 Borst et al.
2009/0129868 A1 5/2009 Millheim
2009/0178853 A1 7/2009 Pavlik
2009/0178854 A1 7/2009 Pavlik
2009/0218106 A1 9/2009 Stukey et al.
2009/0223679 A1 9/2009 Moncus et al.
2009/0255688 A1 10/2009 Pleskie
2009/0272522 A1 11/2009 Ring et al.
2009/0288832 A1 11/2009 Comeaux et al.
2009/0294134 A1 12/2009 Jones et al.
2009/0294136 A1 12/2009 Jones et al.
2009/0308618 A1 12/2009 Collie
2009/0321134 A1 12/2009 Matthews et al.
2010/0000796 A1 1/2010 Boeck
2010/0018721 A1 1/2010 Jennings et al.
2010/0032209 A1 2/2010 Rainey et al.
2010/0181078 A1 7/2010 McKee
2010/0206583 A1 8/2010 Swietlik et al.
2010/0254784 A1 10/2010 Orgeron et al.
2010/0270033 A1 10/2010 Angelle et al.
2010/0288868 A1 11/2010 Rutledge, Sr.
2011/0006149 A1 1/2011 Baugh
2011/0006150 A1 1/2011 Baugh
2011/0011320 A1 1/2011 Yemington
2011/0036559 A1 2/2011 Wood et al.
2011/0048693 A1 3/2011 Wood
2011/0048804 A1 3/2011 Weixler et al.
2011/0067887 A1 3/2011 Moncus et al.
2011/0073299 A1 3/2011 Havinga
2011/0176874 A1 7/2011 Hebert
2011/0188942 A1 8/2011 Millheim
2011/0209651 A1 9/2011 Yemington
2011/0253361 A1 10/2011 Matherne et al.
2011/0253390 A1 10/2011 Boutwell et al.
2011/0278015 A1 11/2011 Mazzanti
2011/0280104 A1 11/2011 McClung, III
2011/0289994 A1 12/2011 Smith et al.
2012/0080180 A1 4/2012 Wood et al.
2012/0103632 A1 5/2012 Havinga
2012/0103633 A1 5/2012 Korach et al.
2012/0145455 A1 6/2012 Mock et al.
2012/0247787 A1 10/2012 Lancaster
2012/0275882 A1 11/2012 Orgeron et al.
2012/0301225 A1 11/2012 Millheim
2012/0318531 A1 12/2012 Shampine et al.
2012/0325486 A1 12/2012 Gilmore et al.
2013/0068494 A1 3/2013 Hung
2013/0092388 A1 4/2013 Gilmore et al.
2013/0121801 A1 5/2013 Gipson
2013/0133898 A1 5/2013 Travis et al.
2013/0145718 A1 6/2013 Bryant et al.
2013/0175048 A1 7/2013 Goode et al.
2013/0181719 A1 7/2013 Wilson
2013/0186640 A1 7/2013 Webre et al.
2013/0264837 A1 10/2013 Liess et al.
2013/0284459 A1 10/2013 Weintraub et al.
2013/0299189 A1 11/2013 Reddy et al.
2013/0299244 A1 11/2013 Reddy et al.
2013/0302114 A1 11/2013 Reddy et al.
2013/0313846 A1 11/2013 Liess et al.
2013/0327543 A1 12/2013 Reddy et al.
2013/0330132 A1 12/2013 Thommesen
2013/0341000 A1 12/2013 Flusche
2013/0341002 A1 12/2013 Flusche
2013/0341003 A1 12/2013 Flusche
2013/0341013 A1 12/2013 Flusche
2013/0341040 A1 12/2013 Flusche
2013/0343837 A1 12/2013 Flusche
2014/0000867 A1 1/2014 Andreychuk et al.
2014/0000895 A1 1/2014 Misselbrook
2014/0030025 A1 1/2014 Bernardoni
2014/0041853 A1 2/2014 Dineen
2014/0048247 A1 2/2014 Watson et al.
2014/0048276 A1 2/2014 Yemington
2014/0076533 A1 3/2014 Witte et al.
2014/0090674 A1 4/2014 Thomas et al.
2014/0116676 A1 5/2014 Placer et al.
2014/0116724 A1 5/2014 McDougall et al.
2014/0138081 A1 5/2014 Yorga et al.
2014/0140791 A1 5/2014 Yorga et al.
2014/0151021 A1 6/2014 Yorga et al.
2014/0230229 A1 8/2014 Dixson et al.
2014/0238696 A1 8/2014 Borst et al.
2014/0238698 A1 8/2014 Jones et al.
2014/0241809 A1 8/2014 Millheim
2014/0305632 A1 10/2014 Pendleton
2015/0000894 A1 1/2015 Henderson
2015/0027733 A1 1/2015 Sipos
2015/0034391 A1 2/2015 McLain
2015/0060049 A1 3/2015 Saurer et al.
2015/0075803 A1 3/2015 Remedio et al.
2015/0129316 A1 5/2015 Harrington et al.
2015/0159445 A1 6/2015 Smith et al.
2015/0159447 A1 6/2015 Miller et al.

(56) References Cited

U.S. PATENT DOCUMENTS

| | | | |
|---|---|---|---|
| 2015/0159452 | A1 | 6/2015 | Miller et al. |
| 2015/0176355 | A1 | 6/2015 | Trinh et al. |
| 2015/0184480 | A1 | 7/2015 | Welsh et al. |
| 2015/0240577 | A1 | 8/2015 | Hassard et al. |
| 2015/0267483 | A1 | 9/2015 | Bujold et al. |
| 2015/0267485 | A1 | 9/2015 | Bujold et al. |
| 2015/0300106 | A1 | 10/2015 | Martin et al. |
| 2015/0330161 | A1 | 11/2015 | Lancaster |
| 2016/0076314 | A1 | 3/2016 | Begnaud |
| 2016/0108674 | A1 | 4/2016 | Von et al. |
| 2016/0138347 | A1 | 5/2016 | Bjrnenak |
| 2016/0175906 | A1 | 6/2016 | Butler |
| 2016/0177640 | A1 | 6/2016 | Dixson et al. |
| 2017/0044838 | A1 | 2/2017 | Pionetti et al. |

FOREIGN PATENT DOCUMENTS

| | | | |
|---|---|---|---|
| AU | 2012207042 | B2 | 5/2013 |
| BR | PI0602644 | A | 11/2006 |
| CA | 953644 | A | 8/1974 |
| CA | 1056808 | A | 6/1979 |
| CA | 1190851 | A | 7/1985 |
| CA | 2014121 | A1 | 10/1990 |
| CA | 2175267 | A1 | 8/1997 |
| CA | 2217413 | A1 | 11/1997 |
| CA | 2183033 | A1 | 2/1998 |
| CA | 2268597 | A1 | 5/2000 |
| CA | 2268557 | A1 | 9/2000 |
| CA | 2292214 | A1 | 6/2001 |
| CA | 2567855 | A1 | 6/2001 |
| CA | 2299765 | A1 | 8/2001 |
| CA | 2322916 | A1 | 4/2002 |
| CA | 2425448 | A1 | 8/2004 |
| CA | 2461977 | A1 | 9/2005 |
| CA | 2465927 | A1 | 11/2005 |
| CA | 2536945 | A1 | 8/2007 |
| CA | 2619207 | A1 | 8/2008 |
| CA | 2633883 | A1 | 12/2008 |
| CA | 2637330 | A1 | 1/2010 |
| CA | 2715613 | A1 | 3/2012 |
| CA | 2728494 | A1 | 6/2012 |
| CA | 2818286 | A1 | 12/2013 |
| CA | 2841375 | A1 | 4/2015 |
| CA | 2838221 | A1 | 6/2015 |
| CA | 2864254 | A1 | 10/2015 |
| CA | 2899223 | A1 | 1/2016 |
| CA | 2860717 | A1 | 2/2016 |
| CA | 2871298 | A1 | 3/2016 |
| CA | 2871825 | A1 | 5/2016 |
| CA | 2898701 | A1 | 5/2016 |
| CN | 2878646 | Y | 3/2007 |
| CN | 1987038 | A | 6/2007 |
| CN | 1995689 | A | 7/2007 |
| CN | 2937438 | Y | 8/2007 |
| CN | 200964788 | Y | 10/2007 |
| CN | 201003369 | Y | 1/2008 |
| CN | 101424163 | A | 5/2009 |
| CN | 101525978 | A | 9/2009 |
| CN | 201326376 | Y | 10/2009 |
| CN | 201486489 | U | 5/2010 |
| CN | 101737009 | A | 6/2010 |
| CN | 201574686 | U | 9/2010 |
| CN | 201581800 | U | 9/2010 |
| CN | 101858196 | A | 10/2010 |
| CN | 201606001 | U | 10/2010 |
| CN | 201650164 | U | 11/2010 |
| CN | 201679452 | U | 12/2010 |
| CN | 201730538 | U | 2/2011 |
| CN | 102003143 | A | 4/2011 |
| CN | 102031784 | A | 4/2011 |
| CN | 102220848 | A | 10/2011 |
| CN | 102287151 | A | 11/2011 |
| CN | 202047764 | U | 11/2011 |
| CN | 102287132 | A | 12/2011 |
| CN | 202073514 | U | 12/2011 |
| CN | 202090870 | U | 12/2011 |
| CN | 102364028 | A | 2/2012 |
| CN | 202156464 | U | 3/2012 |
| CN | 202165034 | U | 3/2012 |
| CN | 202228019 | U | 5/2012 |
| CN | 202249735 | U | 5/2012 |
| CN | 202325234 | U | 7/2012 |
| CN | 202370427 | U | 8/2012 |
| CN | 102756952 | A | 10/2012 |
| CN | 202578488 | U | 12/2012 |
| CN | 102996065 | A | 3/2013 |
| CN | 102996084 | A | 3/2013 |
| CN | 202810717 | U | 3/2013 |
| CN | 202832281 | U | 3/2013 |
| CN | 202833897 | U | 3/2013 |
| CN | 103016044 | A | 4/2013 |
| CN | 202913941 | U | 5/2013 |
| CN | 202913988 | U | 5/2013 |
| CN | 202946054 | U | 5/2013 |
| CN | 103147702 | A | 6/2013 |
| CN | 203050487 | U | 7/2013 |
| CN | 203114156 | U | 8/2013 |
| CN | 203114158 | U | 8/2013 |
| CN | 203161129 | U | 8/2013 |
| CN | 203161130 | U | 8/2013 |
| CN | 203175407 | U | 9/2013 |
| CN | 103334708 | A | 10/2013 |
| CN | 103352668 | A | 10/2013 |
| CN | 103362437 | A | 10/2013 |
| CN | 203239255 | U | 10/2013 |
| CN | 103382809 | A | 11/2013 |
| CN | 203285328 | U | 11/2013 |
| CN | 103670264 | A | 3/2014 |
| CN | 103670272 | A | 3/2014 |
| CN | 203475431 | U | 3/2014 |
| CN | 203487527 | U | 3/2014 |
| CN | 203531804 | U | 4/2014 |
| CN | 203547524 | U | 4/2014 |
| CN | 203603802 | U | 5/2014 |
| CN | 103865500 | A | 6/2014 |
| CN | 103939006 | A | 7/2014 |
| CN | 203701988 | U | 7/2014 |
| CN | 203769643 | U | 8/2014 |
| CN | 203783492 | U | 8/2014 |
| CN | 104047554 | A | 9/2014 |
| CN | 203822224 | U | 9/2014 |
| CN | 203879423 | U | 10/2014 |
| CN | 203891755 | U | 10/2014 |
| CN | 203905805 | U | 10/2014 |
| CN | 203905853 | U | 10/2014 |
| CN | 203905862 | U | 10/2014 |
| CN | 104153727 | A | 11/2014 |
| CN | 203961820 | U | 11/2014 |
| CN | 104295229 | A | 1/2015 |
| CN | 104295241 | A | 1/2015 |
| CN | 204126562 | U | 1/2015 |
| CN | 204163657 | U | 2/2015 |
| CN | 104420843 | A | 3/2015 |
| CN | 204212686 | U | 3/2015 |
| CN | 104533280 | A | 4/2015 |
| CN | 204311968 | U | 5/2015 |
| CN | 204357378 | U | 5/2015 |
| CN | 104775773 | A | 7/2015 |
| CN | 104790890 | A | 7/2015 |
| CN | 204457496 | U | 7/2015 |
| CN | 104863122 | A | 8/2015 |
| CN | 204532161 | U | 8/2015 |
| CN | 204571885 | U | 8/2015 |
| CN | 204609789 | U | 9/2015 |
| CN | 204691673 | U | 10/2015 |
| CN | 105041203 | A | 11/2015 |
| CN | 105064908 | A | 11/2015 |
| CN | 105064934 | A | 11/2015 |
| CN | 105114011 | A | 12/2015 |
| CN | 105156029 | A | 12/2015 |
| CN | 105178847 | A | 12/2015 |
| CN | 105178849 | A | 12/2015 |
| CN | 204827270 | U | 12/2015 |
| CN | 204960798 | U | 1/2016 |

(56) References Cited

FOREIGN PATENT DOCUMENTS

| | | | |
|---|---|---|---|
| CN | 205012942 | U | 2/2016 |
| CN | 205100870 | U | 3/2016 |
| CN | 105484663 | A | 4/2016 |
| CN | 205259970 | U | 5/2016 |
| CN | 105625967 | A | 6/2016 |
| DE | 2241527 | A1 | 3/1973 |
| DE | 2420016 | A1 | 10/1975 |
| DE | 2500614 | A1 | 7/1976 |
| DE | 2614920 | A1 | 10/1976 |
| DE | 2751564 | A1 | 5/1978 |
| DE | 2815149 | A1 | 11/1978 |
| DE | 2731170 | A1 | 1/1979 |
| DE | 2801132 | A1 | 7/1979 |
| DE | 2845878 | A1 | 4/1980 |
| DE | 2947837 | A1 | 7/1981 |
| DE | 3326350 | A1 | 1/1984 |
| DE | 3329313 | A1 | 2/1984 |
| DE | 3249432 | A1 | 7/1984 |
| DE | 3503893 | C1 | 10/1985 |
| DE | 3511846 | A1 | 10/1986 |
| DE | 3521148 | A1 | 12/1986 |
| DE | 3612762 | A1 | 10/1987 |
| DE | 4018735 | A1 | 11/1991 |
| DE | 4333114 | C1 | 10/1994 |
| DE | 19813902 | C1 | 6/1999 |
| DE | 29914363 | U1 | 1/2000 |
| DE | 19947497 | A1 | 4/2001 |
| DE | 10144809 | A1 | 3/2003 |
| DE | 202004016711 | U1 | 3/2005 |
| DE | 102005039790 | B3 | 1/2007 |
| DE | 202008009050 | U1 | 9/2008 |
| DE | 102009054183 | A1 | 11/2010 |
| DE | 102011000320 | A1 | 7/2012 |
| DE | 202011100196 | U1 | 8/2012 |
| DE | 202012007532 | U1 | 9/2012 |
| DE | 102011100358 | A1 | 11/2012 |
| DK | 201370253 | A1 | 11/2014 |
| EP | 0100230 | A2 | 2/1984 |
| EP | 0103283 | A2 | 3/1984 |
| EP | 0150977 | A2 | 8/1985 |
| EP | 0162001 | A1 | 11/1985 |
| EP | 0190669 | A2 | 8/1986 |
| EP | 0192253 | A1 | 8/1986 |
| EP | 0353152 | A1 | 1/1990 |
| EP | 0427304 | A1 | 5/1991 |
| EP | 0517329 | A1 | 12/1992 |
| EP | 0526743 | A1 | 2/1993 |
| EP | 0534919 | A1 | 3/1993 |
| EP | 0740049 | A2 | 10/1996 |
| EP | 0953725 | A2 | 11/1999 |
| EP | 1020616 | A2 | 7/2000 |
| EP | 1098064 | A1 | 5/2001 |
| EP | 1990502 | A2 | 11/2008 |
| EP | 2236734 | A1 | 10/2010 |
| EP | 2757229 | A1 | 7/2014 |
| EP | 2806098 | A2 | 11/2014 |
| EP | 2818626 | A1 | 12/2014 |
| EP | 2930299 | A1 | 10/2015 |
| EP | 3034778 | A1 | 6/2016 |
| FR | 2243322 | A1 | 4/1975 |
| FR | 2283301 | A1 | 3/1976 |
| FR | 2422773 | A1 | 11/1979 |
| FR | 2430385 | A1 | 2/1980 |
| FR | 2469551 | A1 | 5/1981 |
| FR | 2491043 | A1 | 4/1982 |
| FR | 2492043 | A1 | 4/1982 |
| FR | 2509783 | A1 | 1/1983 |
| FR | 2512495 | A1 | 3/1983 |
| FR | 2650335 | A1 | 2/1991 |
| FR | 2702563 | A1 | 9/1994 |
| FR | 2721348 | A1 | 12/1995 |
| FR | 2741907 | A1 | 6/1997 |
| FR | 2975121 | A1 | 11/2012 |
| FR | 2986247 | A1 | 8/2013 |
| FR | 3020396 | A1 | 10/2015 |
| GB | 1482441 | A | 8/1977 |
| GB | 2032494 | A | 5/1980 |
| GB | 2235229 | A | 2/1991 |
| GB | 2283517 | A | 5/1995 |
| GB | 2286847 | A | 8/1995 |
| GB | 2289296 | A | 11/1995 |
| GB | 2296518 | A | 7/1996 |
| GB | 2299600 | A | 10/1996 |
| GB | 2302076 | A | 1/1997 |
| GB | 2315083 | A | 1/1998 |
| GB | 2336864 | A | 11/1999 |
| GB | 2343466 | A | 5/2000 |
| GB | 2345708 | A | 7/2000 |
| GB | 2349660 | A | 11/2000 |
| GB | 2362405 | A | 11/2001 |
| GB | 2391239 | A | 2/2004 |
| GB | 2401354 | A | 11/2004 |
| GB | 2411157 | A | 8/2005 |
| GB | 2431418 | A | 4/2007 |
| GB | 2431419 | A | 4/2007 |
| GB | 2434819 | A | 8/2007 |
| GB | 2447115 | A | 9/2008 |
| GB | 2460311 | A | 12/2009 |
| GB | 2460318 | A | 12/2009 |
| GB | 2472310 | A | 2/2011 |
| GB | 2520512 | A | 5/2015 |
| JP | 06-050074 | A | 2/1994 |
| JP | 06-235216 | A | 8/1994 |
| JP | 08-326456 | A | 12/1996 |
| JP | 09-250287 | A | 9/1997 |
| JP | 11-350864 | A | 12/1999 |
| JP | 2008-075287 | A | 4/2008 |
| KR | 10-2005-0120551 | A | 12/2005 |
| KR | 10-0728103 | B1 | 6/2007 |
| KR | 10-2009-0028200 | A | 3/2009 |
| KR | 10-2009-0090886 | A | 8/2009 |
| KR | 10-0942174 | B1 | 2/2010 |
| KR | 10-2013-0122121 | A | 11/2013 |
| KR | 10-1613313 | B1 | 4/2016 |
| NL | 7405988 | A | 1/1975 |
| NL | 145010 | B | 2/1975 |
| NL | 8802005 | A | 3/1990 |
| NL | 1020310 | C2 | 10/2003 |
| NO | 19996260 | L | 6/2000 |
| RU | 1774985 | A | 11/1992 |
| RU | 01813163 | A | 4/1993 |
| RU | 2002022 | C1 | 10/1993 |
| RU | 2004769 | C1 | 12/1993 |
| RU | 2018656 | C1 | 8/1994 |
| RU | 2061834 | C1 | 6/1996 |
| RU | 2067153 | C1 | 9/1996 |
| RU | 2078902 | C1 | 5/1997 |
| RU | 2081293 | C1 | 6/1997 |
| RU | 2109915 | C1 | 4/1998 |
| RU | 2225825 | C2 | 3/2004 |
| RU | 2235185 | C2 | 8/2004 |
| RU | 2235186 | C2 | 8/2004 |
| RU | 2352751 | C2 | 4/2009 |
| RU | 2366791 | C2 | 9/2009 |
| RU | 2369713 | C1 | 10/2009 |
| RU | 101485 | U1 | 1/2011 |
| RU | 2435922 | C1 | 12/2011 |
| RU | 2010144731 | A | 5/2012 |
| RU | 2453673 | C1 | 6/2012 |
| SE | 8406491 | L | 6/1986 |
| SE | 8702686 | L | 12/1988 |
| SU | 477234 | A1 | 7/1975 |
| SU | 487996 | A1 | 10/1975 |
| SU | 540032 | A1 | 12/1976 |
| SU | 613096 | A1 | 6/1978 |
| SU | 621866 | A1 | 8/1978 |
| SU | 649837 | A1 | 2/1979 |
| SU | 713991 | A2 | 2/1980 |
| SU | 732488 | A1 | 5/1980 |
| SU | 840279 | A1 | 6/1981 |
| SU | 939721 | A1 | 6/1982 |
| SU | 972077 | A1 | 11/1982 |
| SU | 1078049 | A1 | 3/1984 |
| SU | 1092272 | A1 | 5/1984 |

(56) References Cited

FOREIGN PATENT DOCUMENTS

| | | | |
|---|---|---|---|
| SU | 1137178 | A1 | 1/1985 |
| SU | 1265279 | A1 | 10/1986 |
| SU | 1411426 | A1 | 7/1988 |
| SU | 1469093 | A1 | 3/1989 |
| SU | 1566004 | A1 | 5/1990 |
| SU | 1620592 | A1 | 1/1991 |
| SU | 1686119 | A1 | 10/1991 |
| SU | 1761946 | A2 | 9/1992 |
| WO | 96/11322 | A1 | 4/1996 |
| WO | 96/28633 | A2 | 9/1996 |
| WO | 96/30624 | A1 | 10/1996 |
| WO | 97/10411 | A1 | 3/1997 |
| WO | 97/40255 | A2 | 10/1997 |
| WO | 97/42394 | A1 | 11/1997 |
| WO | 98/07954 | A1 | 2/1998 |
| WO | 98/07957 | A1 | 2/1998 |
| WO | 98/12410 | A1 | 3/1998 |
| WO | 98/13555 | A1 | 4/1998 |
| WO | 98/15713 | A1 | 4/1998 |
| WO | 98/33619 | A1 | 8/1998 |
| WO | 98/34005 | A1 | 8/1998 |
| WO | 99/11902 | A1 | 3/1999 |
| WO | 99/58810 | A2 | 11/1999 |
| WO | 00/03600 | A2 | 1/2000 |
| WO | 00/04269 | A2 | 1/2000 |
| WO | 00/05483 | A1 | 2/2000 |
| WO | 00/06868 | A1 | 2/2000 |
| WO | 00/22277 | A1 | 4/2000 |
| WO | 00/22278 | A1 | 4/2000 |
| WO | 00/34620 | A1 | 6/2000 |
| WO | 00/43632 | A2 | 7/2000 |
| WO | 00/47863 | A1 | 8/2000 |
| WO | 01/33033 | A1 | 5/2001 |
| WO | 01/34934 | A2 | 5/2001 |
| WO | 01/57355 | A1 | 8/2001 |
| WO | 01/69034 | A2 | 9/2001 |
| WO | 01/79652 | A1 | 10/2001 |
| WO | 01/89771 | A1 | 11/2001 |
| WO | 02/20938 | A1 | 3/2002 |
| WO | 02/79602 | A1 | 10/2002 |
| WO | 03/70565 | A2 | 8/2003 |
| WO | 03/80990 | A1 | 10/2003 |
| WO | 2004/044374 | A1 | 5/2004 |
| WO | 2004/048249 | A1 | 6/2004 |
| WO | 2004/057147 | A2 | 7/2004 |
| WO | 2004/070161 | A1 | 8/2004 |
| WO | 2004/074631 | A1 | 9/2004 |
| WO | 2005/021927 | A1 | 3/2005 |
| WO | 2005/038192 | A1 | 4/2005 |
| WO | 2005/100737 | A1 | 10/2005 |
| WO | 2005/110020 | A2 | 11/2005 |
| WO | 2006/027553 | A1 | 3/2006 |
| WO | 2006/133350 | A2 | 12/2006 |
| WO | 2007/093787 | A1 | 8/2007 |
| WO | 2007/106999 | A1 | 9/2007 |
| WO | 2008/068546 | A1 | 6/2008 |
| WO | 2008/127740 | A2 | 10/2008 |
| WO | 2009/001088 | A1 | 12/2008 |
| WO | 2009/026449 | A1 | 2/2009 |
| WO | 2009/040569 | A2 | 4/2009 |
| WO | 2009/048319 | A2 | 4/2009 |
| WO | 2009/135217 | A2 | 11/2009 |
| WO | 2009/147040 | A2 | 12/2009 |
| WO | 2009/156722 | A2 | 12/2009 |
| WO | 2010/010326 | A2 | 1/2010 |
| WO | 2010/089573 | A1 | 8/2010 |
| WO | 2011/014440 | A1 | 2/2011 |
| WO | 2011/016719 | A1 | 2/2011 |
| WO | WO-2011097380 | A1 | 8/2011 |
| WO | 2011/103674 | A1 | 9/2011 |
| WO | 2011/135541 | A2 | 11/2011 |
| WO | 2012/060920 | A1 | 5/2012 |
| WO | 2012/075585 | A1 | 6/2012 |
| WO | 2013/022449 | A1 | 2/2013 |
| WO | 2013/081468 | A1 | 6/2013 |
| WO | 2013/101512 | A1 | 7/2013 |
| WO | 2013/125961 | A1 | 8/2013 |
| WO | 2013/142874 | A1 | 9/2013 |
| WO | 2013/173459 | A1 | 11/2013 |
| WO | 2014/025335 | A1 | 2/2014 |
| WO | 2014/066368 | A2 | 5/2014 |
| WO | 2014/073959 | A1 | 5/2014 |
| WO | 2014/089615 | A1 | 6/2014 |
| WO | 2014/179727 | A1 | 11/2014 |
| WO | 2014/179740 | A1 | 11/2014 |
| WO | 2014/186889 | A1 | 11/2014 |
| WO | 2015/016757 | A1 | 2/2015 |
| WO | 2015/016758 | A1 | 2/2015 |
| WO | 2015/057130 | A2 | 4/2015 |
| WO | 2015/076775 | A1 | 5/2015 |
| WO | 2015/086656 | A2 | 6/2015 |
| WO | 2015/093969 | A1 | 6/2015 |
| WO | 2015/100380 | A1 | 7/2015 |
| WO | 2015/113896 | A2 | 8/2015 |
| WO | 2015/113899 | A2 | 8/2015 |
| WO | 2015/113901 | A2 | 8/2015 |
| WO | 2015/117240 | A1 | 8/2015 |
| WO | 2015/164911 | A1 | 11/2015 |
| WO | 2016/081215 | A1 | 5/2016 |

OTHER PUBLICATIONS

International Search Report for PCT/AU2017/050508, dated Sep. 11, 2017.

First Office Action for Chile Application No. 201901979, dated Nov. 5, 2020.

First Office Action and Search Report for Application No. 201780084038.3 issued to China, dated Sep. 22, 2020.

Extended European Search Report for Application No. EPO 17892541.8, dated Sep. 18, 2020.

First Office Action for Application No. 201901977 to Chile, dated Oct. 26, 2020.

First Office Action for Application No. 201780084037.9 to China, dated Sep. 22, 2020.

Extended European Search Report for European Application No. 17893326.3, dated Sep. 18, 2020.

* cited by examiner

ROTARY DRILL HEAD FOR COILED TUBING DRILLING APPARATUS

RELATED APPLICATION

This is the United States national phase of International Patent Application No. PCT/AU2017/051098, filed Oct. 11, 2017, which claims the priority benefit of Australian provisional patent application 2017900143 filed on 18 Jan. 2017 and International patent application PCT/AU2017/050508 filed on 30 May 2017. The entire contents of each of the foregoing are expressly incorporated herein by reference.

TECHNICAL FIELD

The present invention relates to a rotary drill head for a coiled tubing drilling apparatus, primarily for use in mineral exploration, the drilling apparatus being of the type where the coiled tubing is not required to rotate about its longitudinal axis in order for the drilling apparatus to operate.

BACKGROUND OF INVENTION

Mineral exploration has historically used rotating drill strings (being a series of attached, rigid, pipe sections) with drill bits attached at one end to drill subterranean holes in an effort to locate valuable mineral deposits. As a rotating drill bit drills into the earth to form a borehole, additional pipe sections are added in order to drill deeper, while the opposite occurs as the drill bit is withdrawn from the borehole. A significant amount of time and energy (and thus cost) are consumed in adding and removing these pipe sections to assemble and disassemble drill strings during drilling.

Coiled tubing has been developed as an alternative to the use of drill strings (albeit typically for use in the oil industry not for mineral exploration), the coiled tubing typically being a ductile metal available in virtually unlimited lengths. The use of coiled tubing involves the uncoiling of a tube from a reel carrying such tubing, typically by an injector located above and close to a borehole, the injector being responsible for raising and lowering the tubing. The reel is typically located horizontally away from the injector and the borehole, and a curved guide (often referred to as a "goose-neck") is used between the reel and the injector to guide the tubing from the reel across the apparatus to the injector. An example of this can be seen in FIG. 6 of US patent publication 2013/0341001 A1.

In most coiled tubing drilling, a bottom hole assembly (BHA) located at the bottom of the tubing typically includes a mud motor that powers and rotates a drill bit (given that the coiled tubing does not rotate about its own longitudinal axis), the mud motor being powered by the motion of drilling fluid pumped from the surface through the coiled tubing. In other forms of coiled tubing drilling, above-ground apparatus has been developed to allow for the rotation of the coiled tubing about its longitudinal axis. Needless to say, substantial and complex above-ground apparatus is required to be able to rotate an entire reel of coiled tubing to achieve such rotation of the tubing, and the present invention does not relate to rotating coiled tubing drilling of this type.

However, in the normal operation cycle of even a "non-rotating" coiled tubing drilling apparatus, there is still often a need for drilling of the conventional type that uses rotating drill strings and thus the insertion and connection of multiple pipe sections down a borehole. Typically this need occurs at the commencement of drilling a borehole, such as during drilling through the regolith. Also, it will be appreciated that even with coiled tubing drilling apparatus, there is still a need for the installation of casing, which typically requires the ability to insert and rotate multiple casing sleeves into a borehole and to subsequently inject cement or the like down the borehole through the casing sleeve to subsequently pass back up the borehole between the walls of the borehole and the exterior of the casing sleeve.

With coiled tubing drilling to date, this has typically required the use of additional fluid handling equipment associated with a traditional rotary drill head, such as that used to drill with conventional drill strings, so as to be able to provide both torque and drilling fluid to a bottom hole assembly. It is an aim of the present invention to avoid the use of such additional fluid handling equipment in non-rotating coiled tubing drilling apparatus.

Before turning to a summary of the present invention, it must be appreciated that throughout this description, terms such as "horizontal" and "vertical", "upper" and "lower", and "before" and "after" will be used. It should be understood that these and other similar orientation-type descriptive terms are made in relation to the orientation of an operational drill rig, which would normally be located on a reasonably flat (and thus horizontal) surface at ground level, and with respect to a normal tubing pathway on and off a reel and down and up a borehole. The terms are not, however, intended to bring operational limitations, or a requirement for parts of the apparatus to be perfectly horizontal or perfectly vertical.

Finally, it should also be noted that discussion of the background to the invention herein is included to explain the context of the invention. This is not to be taken as an admission that any of the material referred to was published, known or part of the common general knowledge as at the priority date of this application.

SUMMARY OF INVENTION

The present invention provides a mobile, coiled tubing drilling apparatus with a rotary drill head, the apparatus including a non-rotating mast on a mobile platform, the mast having mounted thereon an injector below a coiled tubing reel, the injector defining an operational axis for the coiled tubing, wherein the rotary drill head is pivotally mounted on the injector so as to be movable between a retracted position away from the operational axis and an operating position in line with the operational axis, the rotary drill head including a top swivel for non-rotating connection to the coiled tubing and a bottom spindle for rotating connection to a pipe section, the top swivel and the bottom spindle providing fluid communication between connected coiled tubing and connected pipe section during operation.

In another form, the present invention provides a mobile, coiled tubing drilling apparatus, the apparatus including a non-rotating mast on a mobile platform, the mast having mounted thereon an injector, a coiled tubing reel having a tubing pay-off point associated therewith, and a tubing control system, the injector defining an operational axis for the coiled tubing, wherein:

- the tubing control system is between the reel and the injector, and includes a tubing abutment adjacent the tubing pay-off point for applying an opposite bend to the tubing during pay-out of the tubing; and
- the reel is mounted for horizontal (x,y) movement such that, during pay-out of the tubing, the tubing pay-off point can be maintained generally above the injector, and can also be moved towards or away from the tubing abutment;

the apparatus also including a rotary drill head pivotally mounted on the injector so as to be movable between a retracted position away from the operational axis and an operating position in line with the operational axis, the rotary drill head including a top swivel for non-rotating connection to the coiled tubing and a bottom spindle for rotating connection to a pipe section, the top swivel and the bottom spindle providing fluid communication between connected coiled tubing and connected pipe section during operation.

During further description of the present invention, two modes of operation will be referred to. The first mode will be a coiled tubing drilling mode, where the coiled tubing is inserted down the borehole and fluid passed down the tubing powers the bottom hole assembly. The second mode will be a conventional rotating drill string mode where the coiled tubing connects to the top swivel of the rotary drill head and moves no further than that, while pipe sections are connected to the bottom spindle of the rotary drill head forming a rotating drill string for the bottom hole assembly. The use of the present invention allows for a relatively simple transition between the two operation modes, with relatively simple apparatus.

During the first mode of operation, the reel may be mounted for horizontal (x,y) movement such that, during pay-out of the tubing, the tubing pay-off point can be maintained generally above the injector but away from the injector's operational axis, the operational axis being defined by the pathway through the injector of the longitudinal axis of the tubing.

In contrast, and in relation to the re-coiling of the tubing that would occur during the first mode when the tubing is being withdrawn from the borehole, given that the tubing entering the injector from below has already been straightened, and thus is not subjected to the existing bend that is present with coiled tubing being uncoiled, it is envisaged that the tubing abutment need not be utilised by the apparatus during tubing take-up, and that a tubing take-on point (being essentially the same point during re-coiling as the tubing pay-off point during uncoiling) will actually be as close as operationally possible to a point along the injector's operational axis, and thus will be directly above the injector. During take-up, it will be appreciated that the only bend event that need be applied to the tubing is the bending created by the re-coiling itself.

Therefore, the reel may also mounted for horizontal (x,y) movement such that, during take-up of the tubing, the tubing take-on point can be maintained directly above the injector at a point along the injector's operational axis.

The tubing control system may include an adjustable tubing straightener after the tubing abutment and before the injector, the tubing straightener being adjustable such that it can engage tubing entering or exiting the injector and be utilised to provide more or less (or no) force to tubing entering or exiting the injector. For example, in one form, the adjustable tubing straightener will engage with tubing entering the injector (during pay-out), but not with tubing exiting the straightener (during take-up), for reasons that will be outlined below.

The tubing abutment may be fixed with respect to the mast so that the movement of the reel to maintain the tubing pay-off point generally above the injector during pay-out of the tubing also positions the tubing pay-off point of the reel adjacent the tubing abutment so that the tubing engages with the tubing abutment. In this respect, this engagement with the tubing abutment places an opposite bend in the tubing during pay-out (such a bend being "opposite" to the bend in the tubing that already exists in the coiled tubing from it being coiled on the reel), which in the preferred form occurs before the tubing passes through the adjustable tubing straightener and the injector.

Still in relation to the first mode of operation, the application of this opposite bend to the tubing at a location closely adjacent to the tubing pay-off point has been found to minimise stress on the tubing (and thus increase the operational life of the tubing) while reasonably accurately aligning the tubing with the injector and, if present, the adjustable tubing straightener. Indeed, although an adjustable tubing straightener is required to be adjustable and is referred to as a straightener, in practice, because of the arrangement of the tubing abutment in the manner outlined above, it has been found that only minimal further stresses are added to the tubing if an adjustable tubing straightener is adopted, and which then tends to actually only require minimal adjusting and minimal straightening.

Additionally, the application of the opposite bend to the tubing at a location closely adjacent to the tubing pay-off point has been found to reduce any residual plastic bend remaining in the tubing before entering the injector and the borehole, assisting in avoiding subsequent difficulties with the control and direction of the borehole.

In contrast to this engagement of the tubing with the tubing abutment during pay-out, during take-up of the tubing it is preferred to avoid such engagement by moving the reel away from the tubing abutment (and out of engagement with it) such that, as mentioned above, the take-on point is maintained generally above the injector at a point along the injector's operational axis. Additionally, the tubing is ideally not engaged by the adjustable straightener during take-up. In this way, no additional bend event occurs to the tubing during take-up (via either the adjustable straightener or the tubing abutment), other than the bending of the tubing that occurs as the tubing is re-coiled back on to the reel.

In one form, the tubing abutment may be an elongate abutment beam, fixed generally vertically to the mast with an upper end and a lower end, and with the upper end being the end located adjacent the tubing pay-off point of the reel during operation. In this form, the uncoiling tubing will engage with the upper end of the abutment beam and will ideally be guided along the abutment beam to the injector (or an adjustable straightener, if present) during pay-out of the tubing. Preferably, the elongate abutment beam will be a substantially straight and elongate abutment beam, having a channel therealong that is capable of receiving and guiding therealong tubing from the reel.

In relation to the second mode of operation, being a rotating drill string mode where the coiled tubing connects to the top swivel of the rotary drill head and moves no further than that, while pipe sections are connected to the bottom spindle of the rotary drill head forming therebelow a rotating drill string, the fluid communication provided between connected coiled tubing and connected pipe section during operation permits drilling fluid to be provided for drilling via the coiled tubing rather than having to provide alternative fluid handling equipment and an alternative fluid source. By pivotally mounting the rotary drill head on the injector, the rotary drill head may be moved out of the way of the coiled tubing during the first mode of operation and may be moved back into an operational position for this second mode of operation.

The pivotal mounting of the rotary drill head may be achieved by any suitable means, such as by the use of elongate arms mounted at one end to the injector for pivotal movement and at the other end to opposing sides of the rotary drill head, so as to swing the drill head into and out of position. The movement of the drill head into and out of position may also be achieved by any suitable means, such as by a hydraulic ram or the like.

The present invention thus also provides a method of operating a mobile, coiled tubing drilling apparatus with a rotary drill head, the apparatus including a non-rotating mast on a mobile platform, the mast having mounted thereon an injector below a coiled tubing reel, the injector defining an operational axis for the coiled tubing, wherein the rotary drill head is pivotally mounted on the injector and is moved between a retracted position away from the operational axis and an operating position in line with the operational axis, the rotary drill head including a top swivel for non-rotating connection to the coiled tubing and a bottom spindle for rotating connection to a pipe section, the top swivel and the bottom spindle providing fluid communication between connected coiled tubing and connected pipe section during operation.

The present invention thus also provides a method of operating a mobile, coiled tubing drilling apparatus, the apparatus including a non-rotating mast on a mobile platform, the mast having mounted thereon an injector, a coiled tubing reel having a tubing pay-off point associated therewith, and a tubing control system between the reel and the injector, the injector defining an operational axis for the coiled tubing, wherein the reel is mounted for horizontal (x,y) movement and the tubing control system includes a tubing abutment adjacent the tubing pay-off point, the apparatus also including a rotary drill head pivotally mounted on the injector, the rotary drill head including a top swivel for non-rotating connection to the coiled tubing and a bottom spindle for rotating connection to a pipe section, the method including:

maintaining the tubing pay-off point generally above the injector and adjacent to the tubing abutment during pay-out of the tubing by way of the horizontal (x,y) movement of the reel;

applying an opposite bend to the tubing during pay-out of the tubing by engagement of the tubing adjacent the pay-off point with the tubing abutment;

maintaining a tubing take-on point above the injector and away from the tubing abutment during take-up of the tubing by way of the horizontal (x,y) movement of the reel; and moving the rotary drill head between a retracted position away from the operational axis and an operating position in line with the operational axis, the top swivel and the bottom spindle providing fluid communication between connected coiled tubing and connected pipe section during operation.

In relation to the mobile platform and the requirement for the mast to be non-rotating, in a preferred form the mast is mounted on the mobile platform so as to be movable between an upright drilling position where the reel is above the injector, and a lowered transport position, and also so as to be non-rotatable.

In relation to the mast being mounted so as to be non-rotatable, some drilling rigs that utilise coiled tubing are designed to allow for the rotation of a reel about the vertical axis of the tubing down a borehole. Apparatus of that type has differing design requirements than apparatus of the type that the present invention relates to, being apparatus with non-rotating masts.

Further, the movability of the mast between an upright drilling position where the reel is above the injector, and a lowered transport position, assists with the mobility of the apparatus, allowing for transport to occur by road or by rail in traditional forms. Also, the mobility of the platform itself can of course be provided by any known and desirable means for movement on land, such as by a continuous track propulsion system or a traditional wheel-based propulsion system, while the ancillary drilling equipment that may additionally be provided on the mobile platform may include any of fluid pumps, air compressors, nitrogen purge systems, a diesel engine, hydraulic pumps and valves, and suitable control and operating systems, including remotely controlled systems as necessary.

In another preferred form, not only is the reel mounted on the mast for horizontal (x,y) movement during drilling, but the reel is preferably also mounted on the mast for vertical (z) movement. This vertical movement may be provided by the mast including, for example, a telescoping type of configuration.

Such vertical movement of the reel is advantageous in providing for relatively small vertical movement of a drill bit (for example), located at the bottom of the tubing in a borehole, into and out of contact with the bottom of the borehole, or simply for connecting the coiled tubing with the top swivel of the rotary drill head when transitioning from the first mode of operation to the second mode of operation. This is in preference to such movement having to be provided by rotating the reel, which, if avoided, can further reduce the stresses placed on the tubing, further increasing the operating life of the tubing.

Turning now to a description of the reel and its mounting, which is particularly relevant for the first mode of operation, as mentioned above the reel is mounted on the mast for horizontal (x,y) movement such that the tubing pay-off point can be maintained generally above the injector during pay-out and, preferably, directly above the injector during take-up of the tubing. In this respect, and identifying movement in the x direction as being movement of the reel towards and away from the mast, and movement in the y direction as being movement of the reel along its own longitudinal axis, the x direction movement is preferably provided by mounting the reel on the mast via pivoting arms that are controlled to pivot towards and away from the mast.

Such pivoting movement therefore moves the entire reel towards and away from the mast (as required, either before, during or after drilling) and thus towards and away from the tubing abutment mentioned above. Mounting the reel in this manner thus essentially provides for movement of the longitudinal axis of the reel towards and away from the tubing abutment, and of the coiled tubing on the reel towards and away from the tubing abutment, and thus of the pay-off point of the tubing towards and away from the tubing abutment. Indeed, during drilling, this movement permits the tubing at the pay-off point to be continually urged towards and against the tubing abutment as the tubing uncoils from the reel and as the diameter of the tubing coiled on the reel decreases.

The y direction movement is movement of the reel along its own longitudinal axis, again so as to maintain the pay-off point of the tubing adjacent to the tubing abutment as the tubing uncoils from the reel. In this respect, it will be appreciated that the pay-off point of the tubing will move along the longitudinal axis of the reel as the reel rotates about its longitudinal axis and as the tubing uncoils. With the reel being adapted to provide for continual adjustability of the reel along its longitudinal axis, the reel can be moved in the y direction in response to the pay-off point moving in the y-direction, thus keeping the pay-off point adjacent to the tubing abutment as required, and also keeping the tubing at that point in engagement with the tubing abutment to apply the requisite opposite bend thereto.

BRIEF DESCRIPTION OF DRAWINGS

Having briefly described the general concepts involved with the present invention, a preferred embodiment of a mobile coiled tubing drilling apparatus will now be described that is in accordance with the present invention. However, it is to be understood that the following description is not to limit the generality of the above description.

In the drawings.

DETAILED DESCRIPTION

Figure 1:
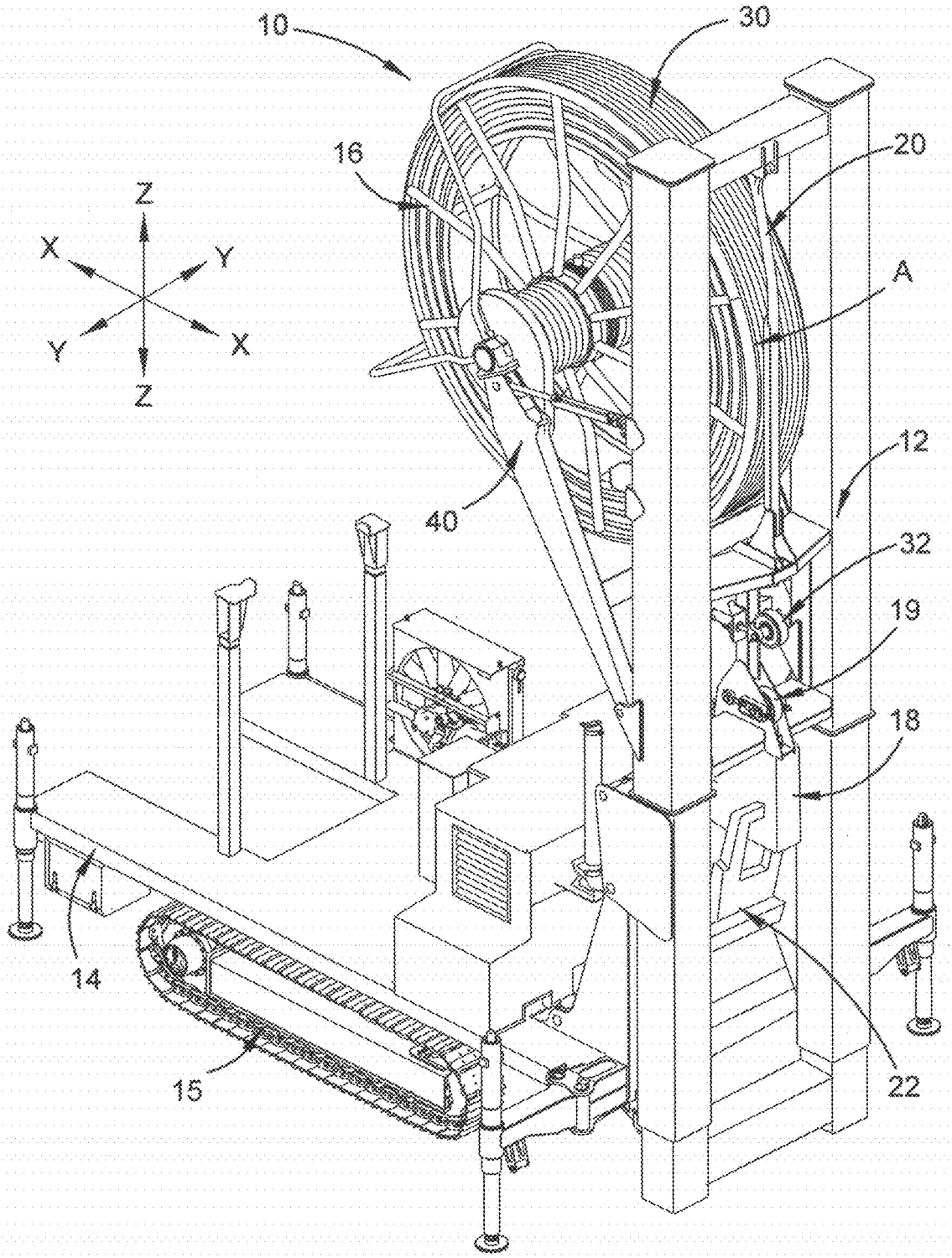
FIG. 1 is a perspective view from above of a mobile, coiled tubing drilling apparatus in accordance with a preferred embodiment of the present invention, deployed in its drilling position.
Figure 2:
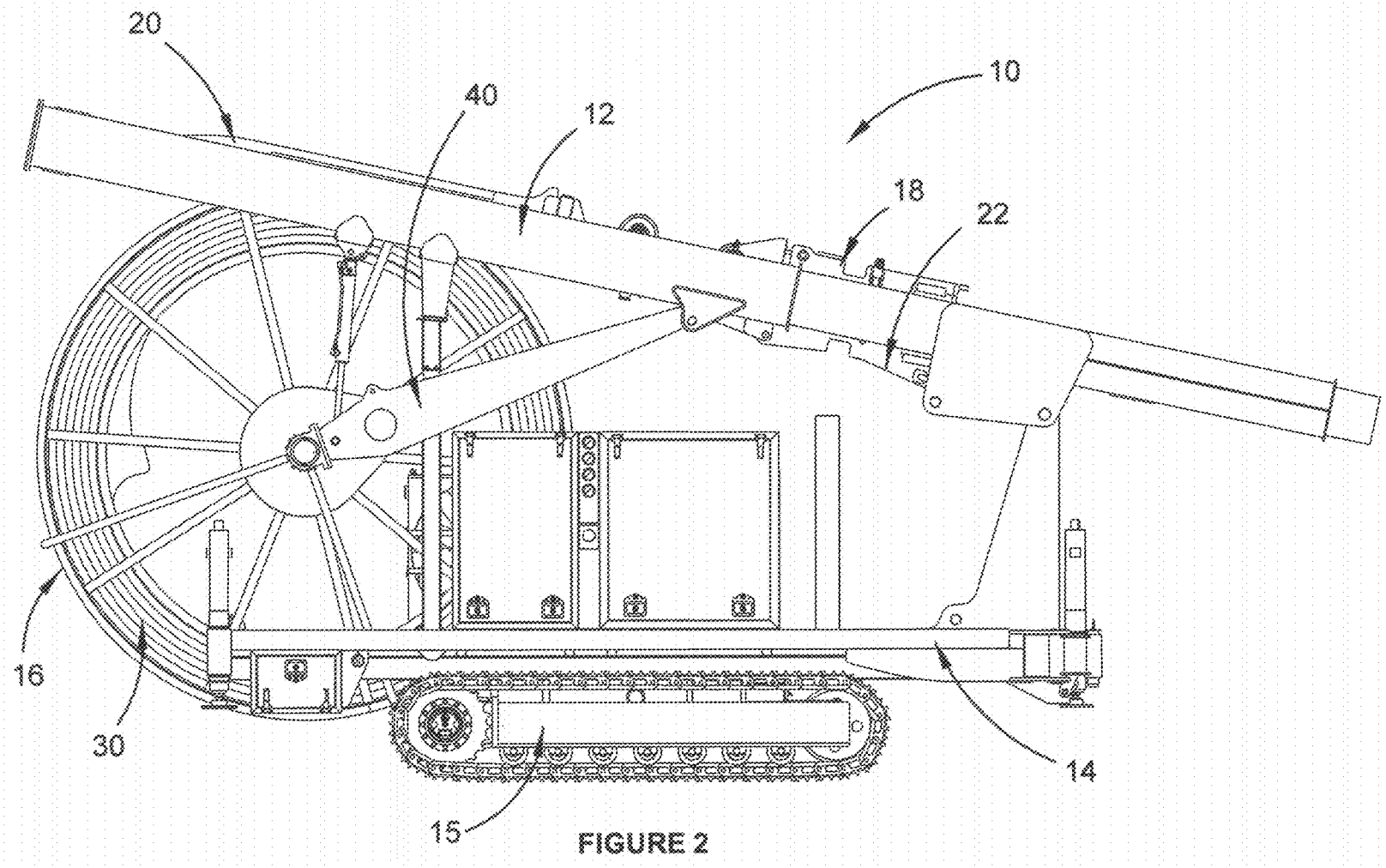
FIG. 2 is a side view of the apparatus of FIG. 1 in a transport position.

Illustrated in FIG. 1 is a mobile, coiled tubing drilling apparatus 10 in its upright drilling position, while FIG. 2 shows the same apparatus 10 in its lowered transport position. The apparatus 10 generally includes a mast 12 mounted on a mobile platform 14 in a manner such that the mast is not rotatable about a vertical axis when in its upright drilling position. The apparatus also includes a coiled tubing reel 16, an injector 18 (with injector guide rollers 19) and a tubing control system in the form of an elongate tubing abutment 20. As will be better understood from the following description, point A in FIG. 1 is a point on the reel and is the general location of both a tubing pay-off point and a tubing take-up point (referred to later as A').

The vertical axis mentioned above is designated in FIG. 1 as the z axis in the identified x-y-z coordinate system, with the x axis (or x direction) being the direction of movement for the tubing pay-off point A (and thus also the reel 16) towards and away from the tubing abutment 20. The y axis (or y direction) is then the direction of movement for the tubing pay-off point A (and again also the reel 16) along the longitudinal axis of the reel 16. It will be appreciated that references to pay-off and take-up of the tubing are references to the first mode of operation of the apparatus, utilising the coiled tubing as the primary drilling means.

The mobility of the platform 14 is provided in this embodiment by a continuous track propulsion system 15, while much of the ancillary drilling equipment provided on the mobile platform (such as fluid pumps, air compressors, nitrogen purge systems, a diesel engine, hydraulic pumps and valves, and suitable control and operating systems) have been omitted from FIG. 1 and FIG. 2 for ease of illustration. Additionally, in this embodiment, the reel 16 is mounted on the mast 12 for vertical (z) movement by way of the mast 12 having a telescoping configuration (not shown).

As mentioned above, such vertical movement of the reel 16 is advantageous in providing for relatively small vertical movement of a drill bit (for example), located at the bottom of the tubing in a borehole, into and out of contact with the bottom of the borehole. This is in preference to such movement having to be provided by rotating the reel 16 to raise or lower the drill bit, which, if avoided, can further reduce the stresses placed on the tubing, further increasing the operating life of the tubing.

The mast 12 of the apparatus 10 also includes, below the injector 18, a pivotally mounted, retractable, rotary drill head 22 (only partly shown) that can be used for drilling with a conventional rotating drill string in a second mode of operation. In this second mode, the apparatus 10 can be used to install casing or the like to the borehole, or to connect and disconnect the different elements of a bottomhole assembly, or simply to drill with a rotating drill string, using fluid provided through the coiled tubing, which will be described in more detail below with reference to FIGS. 5(*a*), 5(*b*), 6 and 7.

Figure 3A:
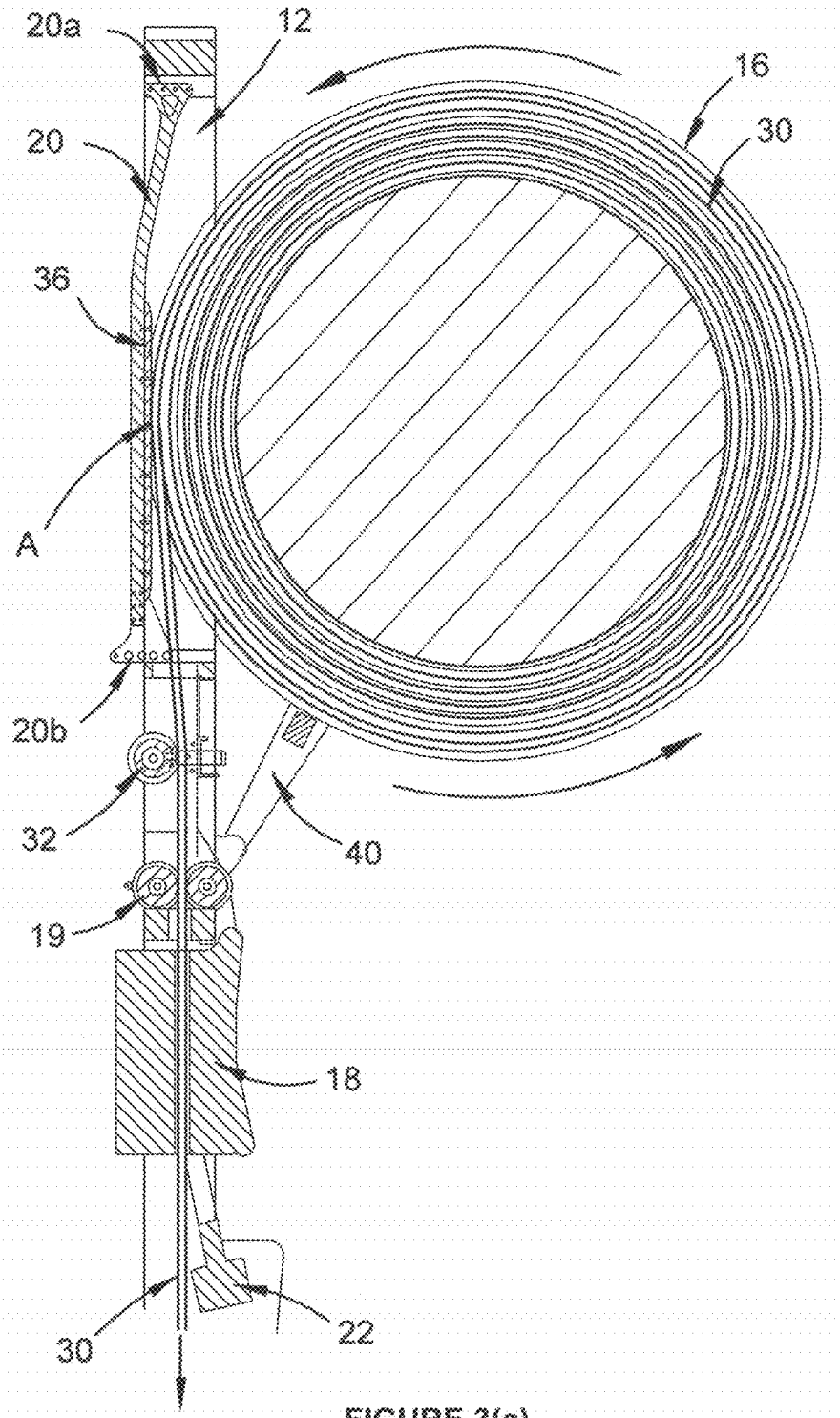
FIGS. 3(*a*) and 3(*b*) are schematic side views of the mast and reel of the apparatus of FIG. 1 when in tubing pay-out mode (FIG. 3(*a*)) and tubing take-up mode (FIG. 3(*b*))
Figure 3B:
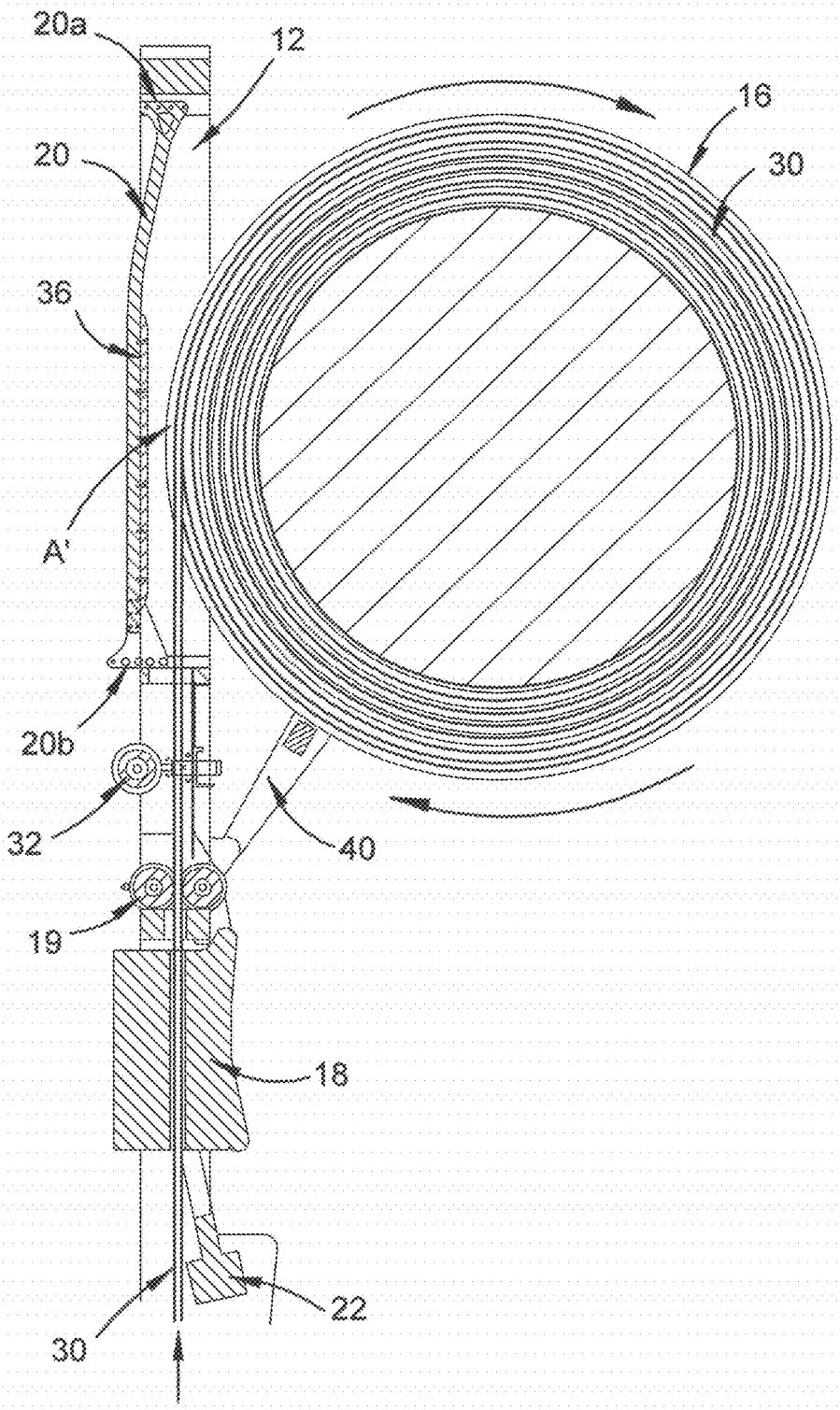

Referring now to FIGS. 3*a* and 3*b*, the reel 16 can be seen mounted for horizontal (x,y) movement, with the x direction being left-right across the page and the y direction being into and out of the page, such that, during pay-out of the tubing 30, the tubing pay-off point A can be maintained generally above the injector 18 but away from the injector's operational axis, the operational axis being defined by the pathway through the injector 18 of the longitudinal axis of the tubing 30 therein.

In this embodiment, the tubing control system of the apparatus 10 also includes an adjustable tubing straightener 32 after the tubing abutment 20 and before the injector 18, the tubing straightener 32 being adjustable such that it can engage tubing 30 entering or exiting the injector 18 and be utilised to provide more or less (or no) force to tubing 30 entering or exiting the injector 18. In this embodiment, the adjustable tubing straightener 32 is shown in FIG. 3(*a*) as being in engagement with the tubing 30 entering the injector 18 (during pay-out), but in FIG. 3(*b*) is shown not engaging with the tubing 30 exiting the injector 18 (during take-up), for reasons that will be outlined below. The adjustable straightener 32 is a single hydraulic powered roller configured to engage with tubing against a fixed abutment.

The tubing abutment 20 is shown fixed with respect to the mast 12 so that the movement of the reel 16 to maintain the tubing 30 pay-off point A generally above the injector 18 during pay-out of the tubing 30 also positions the tubing pay-off point A adjacent the tubing abutment 20 so that the tubing 30 engages with the tubing abutment 20. As mentioned above, this engagement with the tubing abutment 20 places an opposite bend in the tubing 30 during pay-out (such a bend being "opposite" to the bend in the tubing 30 that already exists in the coiled tubing from it being coiled on the reel 16), which in this embodiment occurs before the tubing 30 passes through the adjustable tubing straightener 32 and the injector 18.

The tubing abutment 20 is an elongate abutment beam, fixed generally vertically to the mast 12 with an upper end 20*a* and a lower end 20*b*, and with the upper end 20*a* being the end located above the tubing pay-off point A of the reel 16 during operation. The uncoiling tubing 30 engages with the abutment beam and is guided along the abutment beam to the adjustable straightener 32 and then to the injector 18 during pay-out of the tubing 30. The elongate abutment beam is substantially straight and elongate, and has a channel 36 therealong that is capable of receiving and guiding therealong tubing 30 from the reel 16.

As mentioned above, the application of this opposite bend to the tubing 30 at a location closely adjacent to the tubing pay-off point A has been found to minimise stress on the tubing 30 (and thus increase the operational life of the tubing 30) while reasonably accurately aligning the tubing 30 with the adjustable tubing straightener 32 and the injector 18. The application of the opposite bend has also been found to reduce any residual plastic bend remaining in the tubing 30 before entering the borehole, assisting in avoiding subsequent difficulties with the control and direction of the borehole.

In contrast, and referring to FIG. 3*b* which shows the re-coiling of the tubing 30 when the tubing 30 is being withdrawn from the borehole (not shown), the tubing 30 entering the injector 18 from below has of course already been straightened, and thus is not subjected to the same existing bend that is present with coiled tubing 30 being uncoiled (FIG. 3(*a*)). In this phase, the tubing abutment 20 is not utilised by the apparatus 10 during tubing take-up, and a tubing take-on point A' (being essentially the same point during re-coiling as the tubing pay-off point A during uncoiling) is made as close as operationally possible to a point along the injector's operational axis, and thus will be directly above the injector 18.

Figure 4A:
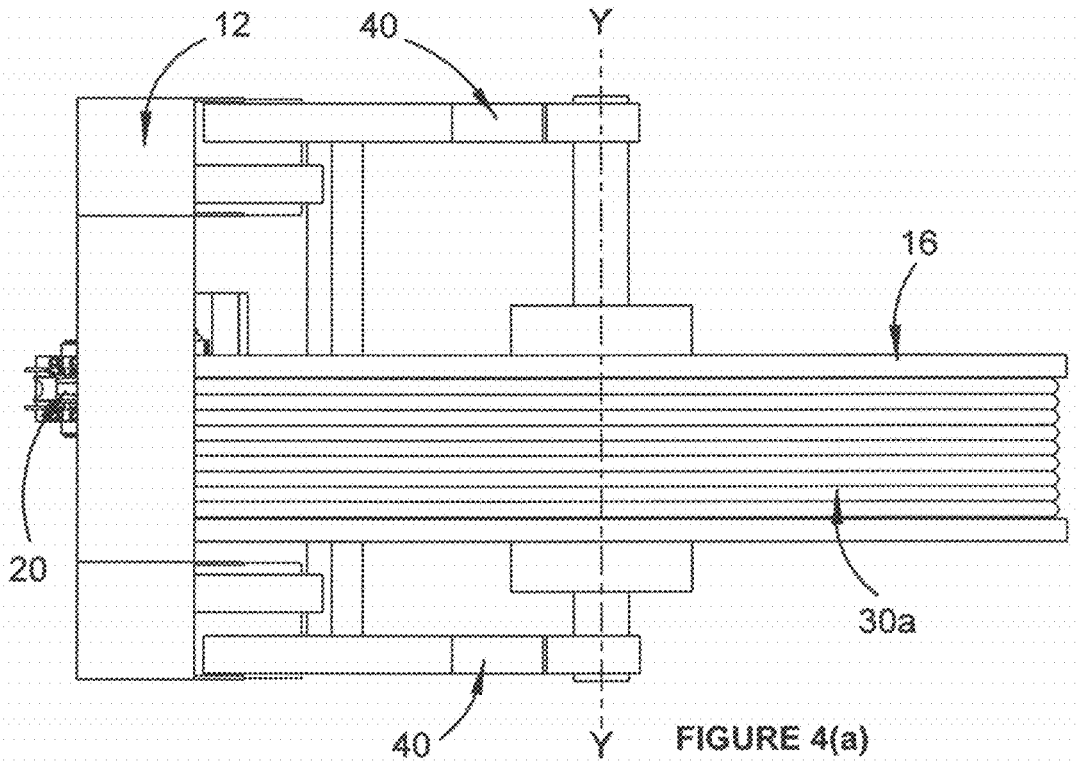
FIGS. 4(*a*) and 4(*b*) are schematic top views of a preferred reel mounting configuration for use with the apparatus of FIG. 1 when in tubing pay-out mode (FIG. 3(*a*))
Figure 4B:
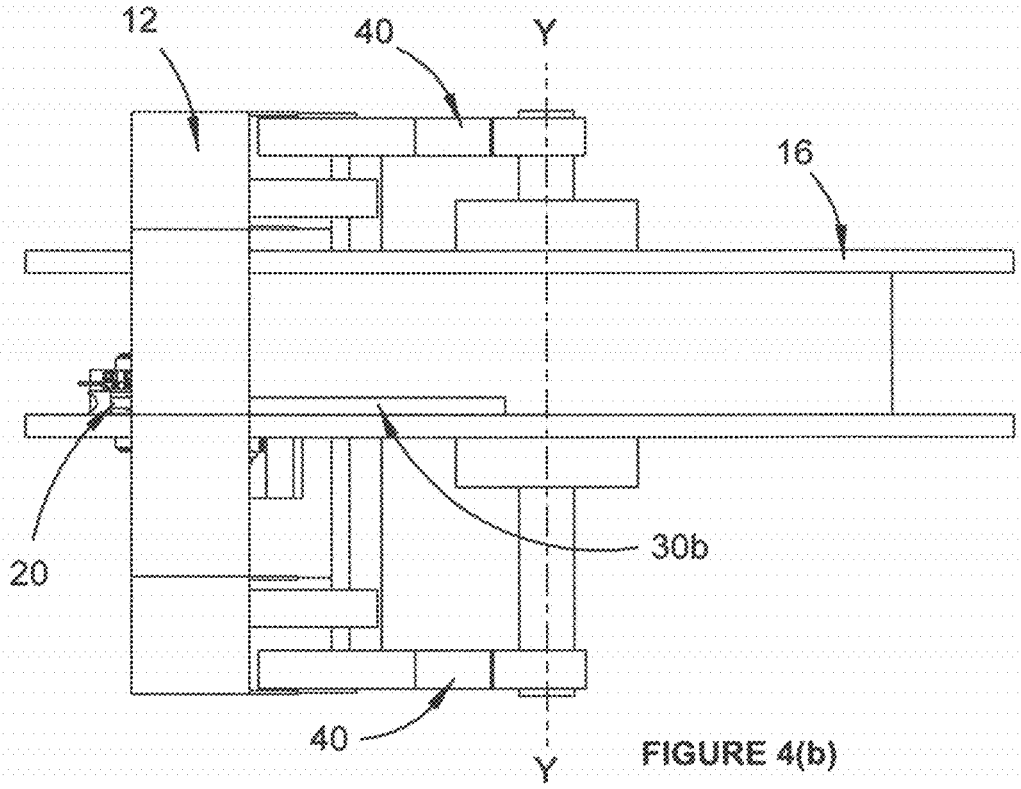

With reference to FIGS. 4(*a*) and 4(*b*), as mentioned above the reel 16 is mounted on the mast 12 for horizontal (x,y) movement such that the tubing pay-off point A can be maintained generally above the injector 18 during pay-out of the tubing 30 and such that the tubing take-on point A' can be maintained directly above the injector 18 during take-up of the tubing 30.

In this respect, and identifying movement in the x direction as being movement of the reel towards and away from the mast 12 (left and right on the page), and movement in the y direction as being movement of the reel 16 along its own longitudinal axis (axis Y-Y in FIGS. 4(*a*) and 4(*b*)), the x direction movement is provided by mounting the reel 16 on the mast 12 via pivoting arms 40 that are controlled to pivot towards and away from the mast 12.

Such pivoting movement therefore moves the entire reel 16 towards and away from the mast 12 (as required, either before, during or after drilling) and thus towards and away from the tubing abutment 20. Mounting the reel 16 in this manner provides for movement of the longitudinal axis Y-Y of the reel 16 towards and away from the tubing abutment 20, and of the coiled tubing 30*a*, 30*b* on the reel 16 towards and away from the tubing abutment 20, and thus of the pay-off point A of the tubing towards and away from the tubing abutment 20.

Indeed, during drilling, this movement permits the tubing 30*a*. 30*b* at the pay-off point A to be continually urged towards and against the tubing abutment 20 as the tubing 30*a*, 30*b* uncoils from the reel 16 and as the diameter of the tubing 30*a*, 30*b* coiled on the reel 16 decreases, as is shown from FIG. 4(*a*) where the reel 16 is full of tubing 30*a* through to FIG. 4(*b*) where the tubing 30*b* is almost entirely unwound from the reel 16.

In this respect, it will be appreciated that the pay-off point A of the tubing 30*a*, 30*b* will move along the longitudinal axis Y-Y of the reel 16 as the reel rotates about its longitudinal axis Y-Y and as the tubing 30*a*, 30*b* uncoils. With the reel 16 being adapted to provide for continual adjustability of the reel 16 along its longitudinal axis Y-Y, the reel can be moved in the y direction in response to the pay-off point A moving in the y-direction, thus keeping the pay-off point A adjacent to the tubing abutment 20 as required, and also keeping the tubing 30*a*, 30*b* at that point in engagement with the tubing abutment 20 to apply the requisite opposite bend thereto.

Figure 5A:
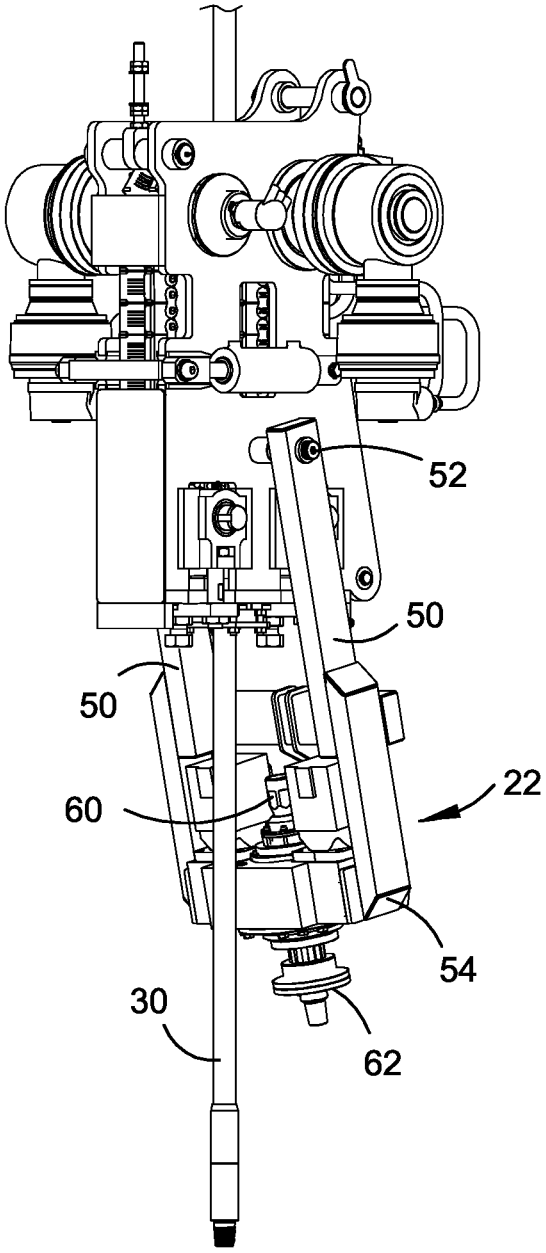
FIGS. 5(*a*) and 5(*b*) are perspective and side views of an embodiment of a rotary drill head pivotally mounted on an injector, being suitable for use with the apparatus of FIGS. 1 to 4, showing the rotary drill head in its retracted position away from the operational axis (in the first mode of operation for the drilling apparatus)
Figure 5B:
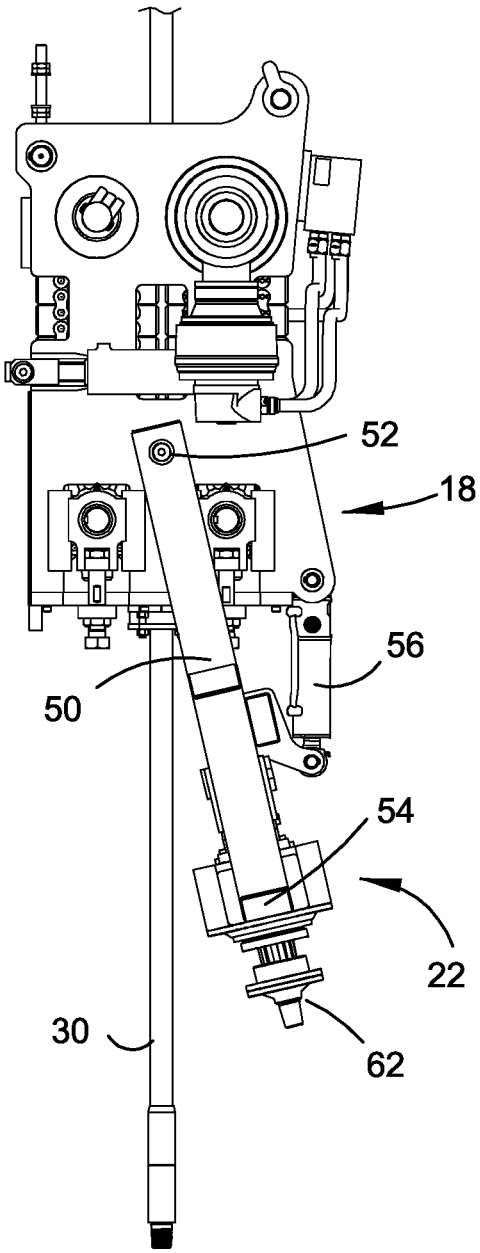

FIGS. 5(*a*), 5(*b*), 6 and 7 illustrate an embodiment of a rotary drill head 22 pivotally mounted on an injector 18, being suitable for use with the apparatus of FIGS. 1 to 4, showing the rotary drill head in its retracted position (FIGS. 5(*a*) and 5(*b*)) away from the operational axis (in the first mode of operation for the drilling apparatus, as described above) and in its operating position (FIGS. 6 and 7) in line with the operational axis (in the second mode of operation for the drilling apparatus, as will now be described.

Figure 6:
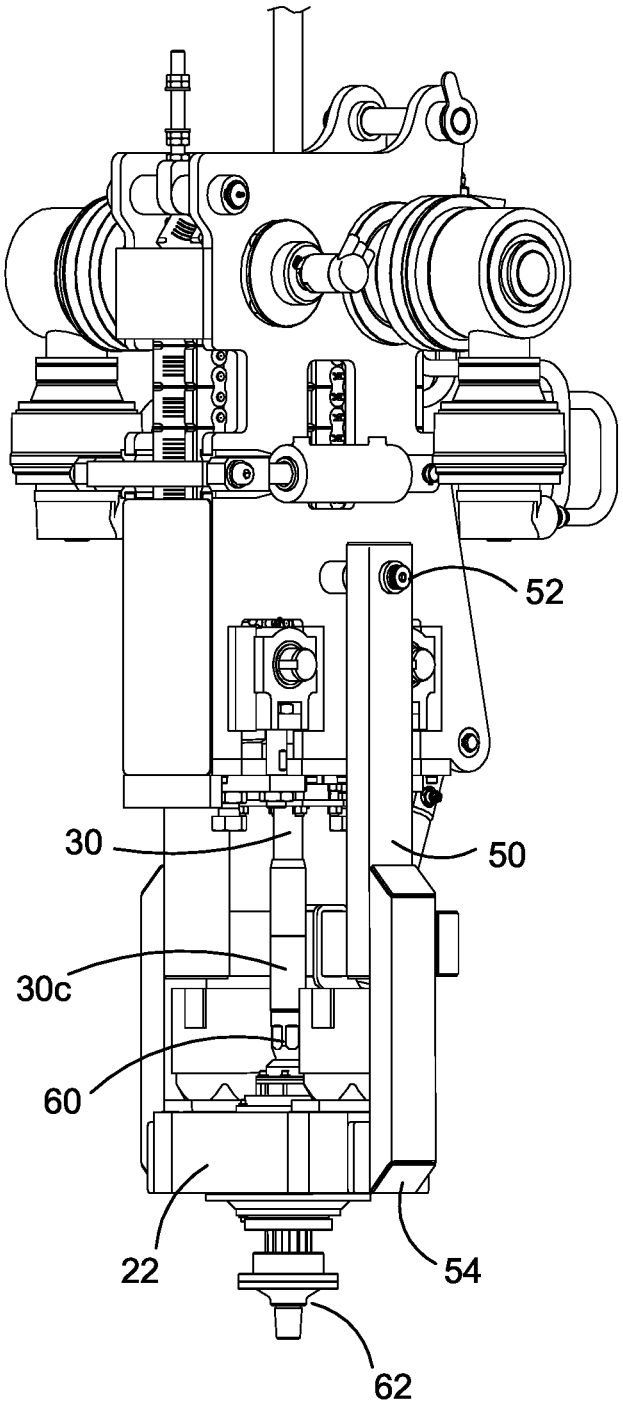
FIG. 6 is a perspective view similar to FIG. 5(*a*) but showing the rotary drill head in its operating position in line with the operational axis (in the second mode of operation for the drilling apparatus)

FIG. 5(*a*) illustrates the use of elongate arms 50 mounted at one end 52 to the injector 18 for pivotal movement and at the other end 54 to opposing sides of the rotary drill head 22, so as to allow movement of the drill head 22 between the retracted position of FIGS. 5(*a*) and 5(*b*) and the operating position of FIG. 6.

FIG. 5(*b*) also shows that movement of the drill head 22 between the retracted position and the operating position is achieved by a hydraulic ram 56 mounted between the injector 18 and the drill head 22.

Figure 7:
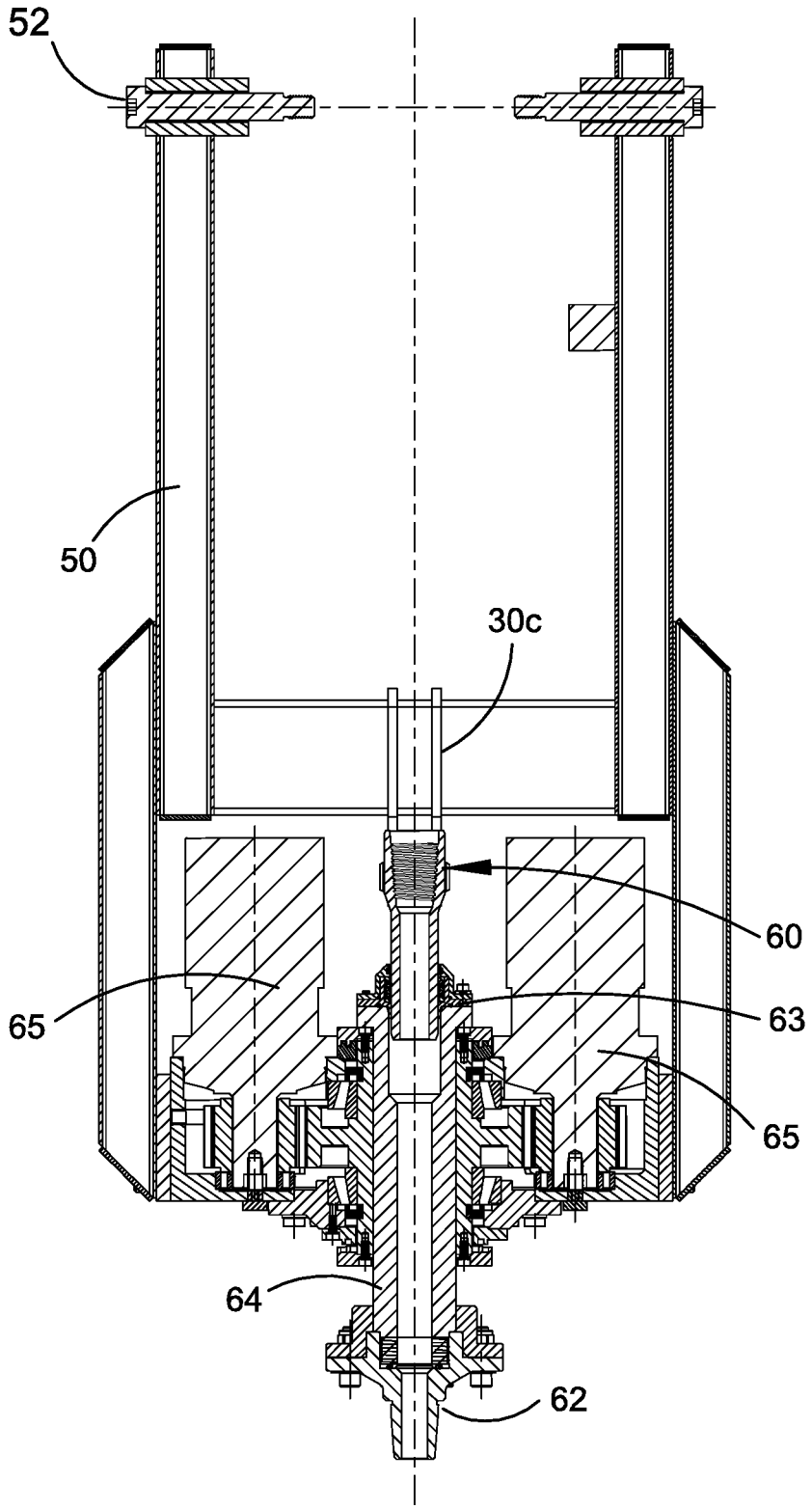
FIG. 7 is a section view through the rotary drill head of FIG. 5(*a*).

The second mode of operation illustrated in FIGS. 6 and 7 is a rotating drill string mode where the coiled tubing 30*c* connects to a top swivel 60 of the rotary drill head 22 and moves no further than that, while pipe sections (not shown) are connected to a bottom spindle 62 of the drill head 22 forming therebelow a rotating drill string. In this respect, the swivel 60 is fixed and does not itself rotate, with the bottom portion thereof being received within the upper portion 63 of the main shaft 64 in a manner that permits the swivel 60 to move axially within the upper portion 63 and the main shaft 64 to rotate relatively to the swivel 60, while maintaining a suitable fluid/air seal therebetween.

Of course, the main shaft 64 is powered by hydraulic motors 65 connected thereto via gears, providing rotation for the bottom spindle 62. The main shaft 64 can be floating to allow for axial movement thereof while, for example, drill rods are being threaded onto the spindle 62.

Fluid communication is provided between the connected coiled tubing 30 and the connected pipe sections (not shown) during operation to permit drilling fluid to be provided for drilling via the coiled tubing 30, through the bore of the top swivel 60, through the hollow drive shaft 64, and through the bore of the bottom spindle 62, there thus being no need to provide alternative fluid handling equipment or an alternative fluid source. By pivotally mounting the rotary drill head 22 on the injector 18, the rotary drill head 22 may be moved out of the way of the coiled tubing 30 during the first mode of operation and may be moved back into an operational position for this second mode of operation.

Finally, there may be other variations and modifications made to the configurations described herein that are also within the scope of the present invention.

The invention claimed is:

1. A mobile, coiled tubing drilling apparatus with a rotary drill head, the apparatus including a non-rotating mast on a mobile platform, the mast having mounted thereon an injector below a coiled tubing reel, the injector defining an operational axis for the coiled tubing, wherein the rotary drill head is pivotally mounted on the injector so as to be movable between a retracted position away from the operational axis and an operating position in line with the operational axis, the rotary drill head including a top swivel for non-rotating connection to the coiled tubing and a bottom spindle for rotating connection to a pipe section, the top swivel and the bottom spindle providing fluid communication between connected coiled tubing and connected pipe section during operation.

2. Apparatus according to claim 1, including elongate arms mounted at one end to the injector for pivotal movement and at the other end to opposing sides of the rotary drill head, so as to allow movement of the drill head between the retracted position and the operating position.

3. Apparatus according to claim 1, wherein movement of the drill head between the retracted position and the operating position is achieved by a hydraulic ram mounted between the injector and the drill head.

4. Apparatus according to claim 1, wherein the top swivel is fixed with a bottom portion thereof received within an upper portion of a main shaft in a manner that permits the swivel to move axially within the upper portion and the main shaft to rotate relatively to the swivel.

5. Apparatus according to claim 4, wherein the main shaft is floating to allow for axial movement thereof while pipe section is connected to the bottom spindle.

6. Apparatus according to claim 1, the coiled tubing reel having a tubing pay-off point associated therewith, and a tubing control system, wherein:

the tubing control system is between the reel and the injector, and includes a tubing abutment adjacent the tubing pay-off point for applying an opposite bend to the tubing during pay-out of the tubing; and the reel is mounted for horizontal (x,y) movement such that, during pay-out of the tubing, the tubing pay-off point can be maintained generally above the injector, and can also be moved towards or away from the tubing abutment.

7. Apparatus according to claim 1, wherein the reel is mounted for horizontal (x,y) movement such that, during pay-out of the tubing, the tubing pay-off point can be maintained generally above the injector but away from the injector's operational axis.

8. Apparatus according to claim 7, wherein the reel is mounted for horizontal (x,y) movement such that, during take-up of the tubing, the tubing take-on point can be maintained directly above the injector at a point along the injector's operational axis.

9. Apparatus according to claim 1, wherein the tubing control system also includes an adjustable tubing straightener after the tubing abutment and before the injector.

* * * * *